US011074845B2

(12) United States Patent
Jang

(10) Patent No.: US 11,074,845 B2
(45) Date of Patent: Jul. 27, 2021

(54) DISPLAY DEVICE

(71) Applicant: Samsung Display Co., Ltd., Yongin-si (KR)

(72) Inventor: Dae Gwang Jang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/846,132

(22) Filed: Apr. 10, 2020

(65) Prior Publication Data

US 2020/0372849 A1 Nov. 26, 2020

(30) Foreign Application Priority Data

May 24, 2019 (KR) ..... 10-2019-0061105

(51) Int. Cl.
*G09G 3/20* (2006.01)

(52) U.S. Cl.
CPC ..... *G09G 3/20* (2013.01); *G09G 2300/0426* (2013.01); *G09G 2300/0439* (2013.01); *G09G 2310/027* (2013.01); *G09G 2310/0286* (2013.01); *G09G 2310/0291* (2013.01); *G09G 2330/021* (2013.01)

(58) Field of Classification Search
CPC ... G09G 2300/0426; G09G 2300/0439; G09G 2300/0861; G09G 2310/0251; G09G 2310/0262; G09G 2310/027; G09G 2310/0286; G09G 2310/0291; G09G 2330/021; G09G 3/20; G09G 3/3233; G09G 3/3291
See application file for complete search history.

(56) References Cited

U.S. PATENT DOCUMENTS

| | | | | |
|---|---|---|---|---|
| 9,721,511 | B2 | 8/2017 | Jeong et al. | |
| 9,837,040 | B2 | 12/2017 | Moon et al. | |
| 10,147,381 | B2 | 12/2018 | Lee et al. | |
| 2008/0135895 | A1* | 6/2008 | Lee | H04N 5/363 257/290 |

(Continued)

FOREIGN PATENT DOCUMENTS

| | | | |
|---|---|---|---|
| KR | 10-2016-0041103 | A | 4/2015 |
| KR | 10-2015-0055253 | A | 5/2015 |

(Continued)

*Primary Examiner* — Dmitriy Bolotin
(74) *Attorney, Agent, or Firm* — Lewis Roca Rothgerber Christie LLP

(57) ABSTRACT

A display device includes a first amplifier and second data amplifier connected to a first data line and second data line, to a first high voltage power source and second high voltage power source and to a first low voltage power source and second low voltage power source, respectively, a first pixel and second pixel each having a data input terminal connected to the first data line and second data line, respectively. The first high voltage power source and the first low voltage power source determine an upper limit and a lower limit of an output voltage of the first amplifier, respectively, the second high voltage power source and the second low voltage power source determine an upper limit and a lower limit of an output voltage of the second amplifier, respectively, and the first low voltage power source and second low voltage power source are independent power sources.

20 Claims, 13 Drawing Sheets

(56) References Cited

U.S. PATENT DOCUMENTS

| | | | | |
|---|---|---|---|---|
| 2008/0158204 | A1* | 7/2008 | Chang | G09G 3/3677 345/204 |
| 2009/0278774 | A1* | 11/2009 | Chen | G09G 3/2007 345/83 |
| 2013/0082936 | A1* | 4/2013 | Islamkulov | H01L 27/14609 345/173 |
| 2016/0093270 | A1* | 3/2016 | Lee | G09G 3/3688 345/690 |
| 2018/0061307 | A1* | 3/2018 | Inoue | G09G 3/3275 |
| 2018/0197485 | A1* | 7/2018 | Jose | G09G 3/3614 |
| 2020/0372849 | A1* | 11/2020 | Jang | G09G 3/3233 |

FOREIGN PATENT DOCUMENTS

| | | | |
|---|---|---|---|
| KR | 10-2016-0037010 | A | 4/2016 |
| KR | 10-2017-0066771 | A | 6/2017 |
| KR | 10-1867817 | B1 | 7/2018 |

* cited by examiner

DISPLAY DEVICE

CROSS-REFERENCE TO RELATED APPLICATION

This application claims priority to and the benefit of Korean Patent Application No. 10-2019-0061105 filed on May 24, 2019 in the Korean Patent Office (KIPO), the entire content of which is incorporated herein by reference.

BACKGROUND

1. Field

The disclosure relates to a display device.

2. Description of the Related Art

As information technology develops, the importance of the display device, which is a connection medium between a user and information, is further emphasized. Accordingly, use of a display device such as a liquid crystal display device, an organic light emitting display device, and a plasma display device has been increasing.

Various solutions have been proposed to reduce power consumption of the display device.

SUMMARY

Aspects of the present disclosure are directed to a display device capable of reducing power consumption by reducing heat loss.

A display device according to an embodiment of the disclosure includes a first amplifier having an output terminal connected to a first data line, the first amplifier being connected to a first high voltage power source and a first low voltage power source, a second amplifier having an output terminal connected to a second data line, the second amplifier being connected to a second high voltage power source and a second low voltage power source, a first pixel having a data input terminal connected to the first data line, and a second pixel having a data input terminal connected to the second data line. The first high voltage power source and the first low voltage power source may determine an upper limit and a lower limit of an output voltage of the first amplifier, respectively, the second high voltage power source and the second low voltage power source may determine an upper limit and a lower limit of an output voltage of the second amplifier, respectively, and the first low voltage power source and the second low voltage power source are independent power sources.

The first pixel may include a p-type transistor having a gate electrode to receive a first data voltage output from the first amplifier is applied, and the second pixel may include a p-type transistor having a gate electrode to receive a second data voltage output from the second amplifier is applied.

The display device may further include a buffer power generator including the first low voltage power source and the second low voltage power source. The buffer power generator may determine a voltage of the first low voltage power source based on a first grayscale value for the first pixel and may determine a voltage of the second low voltage power source based on a second grayscale value for the second pixel.

The buffer power generator may determine that the voltage of the first low voltage power source is lesser in value when the first grayscale value becomes greater in value and may determine that the voltage of the first low voltage power source is greater in value when the first grayscale value becomes lesser in value.

A voltage difference between the first low voltage power source and a first data voltage output from the first amplifier based on the first grayscale value may correspond to a voltage difference between the second low voltage power source and a second data voltage output from the second amplifier based on the second grayscale value.

The first high voltage power source and the second high voltage power source may be independent power sources, and the buffer power generator may determine a voltage of the first high voltage power source based on the first grayscale value and may determine the voltage of the second high voltage power source based on the second grayscale value.

The buffer power generator may determine that the voltage of the first high voltage power source is lesser in value when the first grayscale value becomes greater in value and may determine that the voltage of the first high voltage power source is greater in value when the first grayscale value becomes lesser in value.

A voltage difference between the first high voltage power source and a first data voltage output from the first amplifier based on the first grayscale value may correspond to a voltage difference between the second high voltage power source and a second data voltage output from the second amplifier based on the second grayscale value.

The display device may further include a third amplifier having an output terminal connected to a third data line, and connected to a third high voltage power source and a third low voltage power source, a fourth amplifier having an output terminal connected to a fourth data line, and connected to the first high voltage power source and the first low voltage power source, a third pixel having a data input terminal connected to the third data line, and a fourth pixel having a data input terminal connected to the fourth data line. The first pixel and the fourth pixel may provide a first color, the second pixel may provide a second color different from the first color, and the third pixel may provide a third color different from the first color and the second color.

The display device may further include a fifth pixel may provide the first color and having a data input terminal connected to the first data line, a sixth pixel may provide the second color and having a data input terminal connected to the second data line, a seventh pixel may provide the third color and having a data input terminal connected to the third data line, and an eighth pixel may provide the first color and having a data input terminal connected to the fourth data line. Scan input terminals of the first pixel, the second pixel, the third pixel, and the fourth pixel may be connected to a first scan line, and scan input terminals of the fifth pixel, the sixth pixel, the seventh pixel, and the eighth pixel may be connected to a second scan line next to the first scan line.

The display device may further include a third amplifier having an output terminal connected to a third data line, and connected to the first high voltage power source and the first low voltage power source, a fourth amplifier having an output terminal connected to a fourth data line, and connected to the second high voltage power source and the second low voltage power source, a third pixel having a data input terminal connected to the third data line, and a fourth pixel having a data input terminal connected to the fourth data line. The first pixel may provide a first color, the second pixel and the fourth pixel may provide a second color different from the first color, and the third pixel may provide a third color different from the first color and the second color.

The display device may further include a fifth pixel may provide the third color and having a data input terminal connected to the first data line, a sixth pixel may provide the second color and having a data input terminal connected to the second data line, a seventh pixel may provide the first color and having a data input terminal connected to the third data line, and an eighth pixel may provide the second color and having a data input terminal connected to the fourth data line. Scan input terminals of the first pixel, the second pixel, the third pixel, and the fourth pixel may be connected to a first scan line, and scan input terminals of the fifth pixel, the sixth pixel, the seventh pixel, and the eighth pixel may be connected to a second scan line next to the first scan line.

A display device according to an embodiment of the disclosure includes a first amplifier having an output terminal connected to a first data line, the first amplifier being connected to a first high voltage power source and a first low voltage power source, a second amplifier having an output terminal connected to a second data line, the second amplifier being connected to a second high voltage power source and a second low voltage power source, a first pixel having a data input terminal connected to the first data line, and a second pixel having a data input terminal connected to the second data line. The first high voltage power source and the first low voltage power source may determine an upper limit and a lower limit of an output voltage of the first amplifier, respectively, the second high voltage power source and the second low voltage power source may determine an upper limit and a lower limit of an output voltage of the second amplifier, respectively, and the first high voltage power source and the second high voltage power source are independent power sources.

The first pixel may include an n-type transistor having a gate electrode to receive a first data voltage output from the first amplifier, and the second pixel may include an n-type transistor having a gate electrode to receive a second data voltage output from the second amplifier.

The display device may further include a buffer power generator including the first high voltage power source and the second high voltage power source, and the buffer power generator may determine a voltage of the first high voltage power source based on a first grayscale value for the first pixel and may determine a voltage of the second high voltage power source based on a second grayscale value for the second pixel.

The buffer power generator may determine that the voltage of the first high voltage power source to be greater in value when the first grayscale value becomes greater in value and may determine that the voltage of the first high voltage power source is lesser in value when the first grayscale value becomes lesser in value.

A voltage difference between the first high voltage power source and a first data voltage output from the first amplifier based on the first grayscale value may correspond to a voltage difference between the second high voltage power source and a second data voltage output from the second amplifier based on the second grayscale value.

The first low voltage power source and the second low voltage power source may be independent power sources, and the buffer power generator may determine a voltage of the first low voltage power source based on the first grayscale value and may determine the voltage of the second low voltage power source based on the second grayscale value.

The buffer power generator may determine that the voltage of the first low voltage power source to be greater in value when the first grayscale value becomes greater in value and may determine that the voltage of the first low voltage power source is lesser in value when the first grayscale value becomes lesser in value.

A voltage difference between the first low voltage power source and a first data voltage output from the first amplifier based on the first grayscale value may correspond to a voltage difference between the second low voltage power source and a second data voltage output from the second amplifier based on the second grayscale value.

The display device according to the disclosure may reduce power consumption by reducing heat loss.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
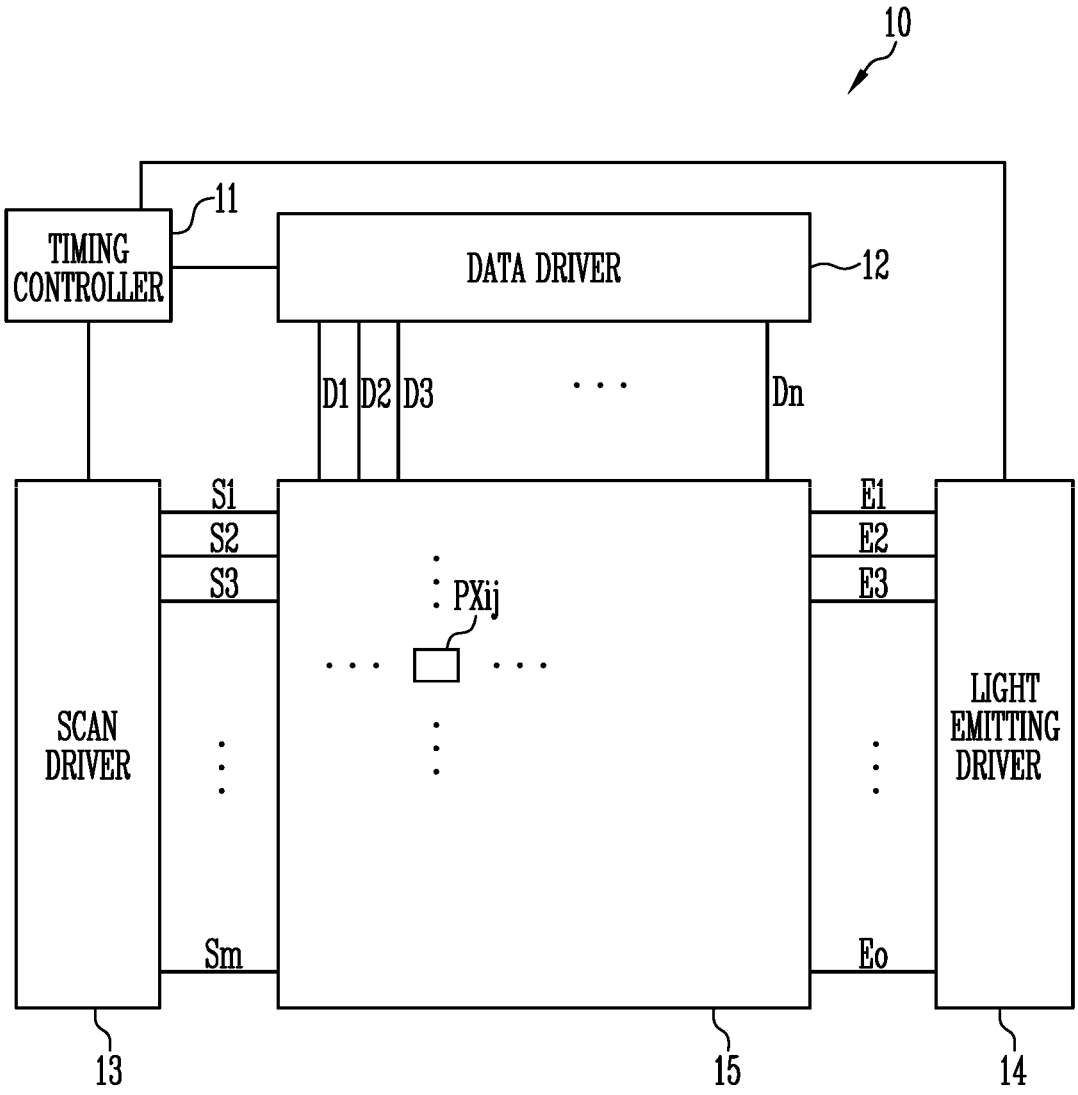
FIG. 1 is a diagram for describing a display device according to an embodiment of the disclosure.

Hereinafter, various embodiments of the disclosure will be described in more detail with reference to the accompanying drawings so that those skilled in the art may easily carry out the disclosure. The disclosure may be implemented in various different forms and is not limited to the embodiments described herein.

In order to clearly describe the disclosure, parts that are not related to the description are omitted, and the same or similar elements are denoted by the same reference numerals throughout the specification. Therefore, the above-described reference numerals may be used in other drawings.

In addition, sizes and thicknesses of each component shown in the drawings are arbitrarily shown for convenience of description, and thus the disclosure is not necessarily limited to those shown in the drawings. In the drawings, thicknesses may be exaggerated to clearly express various layers and areas.

FIG. 1 is a diagram for describing a display device according to an embodiment of the disclosure.

Referring to FIG. 1, a display device 10 according to an embodiment of the disclosure includes a timing controller 11, a data driver 12, a scan driver 13, a light emitting driver 14, and a pixel unit 15.

The timing controller 11 may receive grayscale values (or gray levels) and control signals for each image frame from an external processor. The timing controller 11 may render the grayscale values to correspond to a specification of the display device 10. For example, the external processor may provide a red grayscale value (or red gray level), a green grayscale value (or green gray level), and a blue grayscale value (or blue gray level) for each unit dot. However, for example, when the pixel unit 15 is a pentile structure, because adjacent unit dots share pixels, the pixels may not correspond to the respective grayscale values on a one-to-one basis. In this case, rendering of the grayscale values is desirable. When the pixels correspond to the respective grayscale values on a one-to-one basis, rendering of the grayscale values may be less desirable. The grayscale values that are not rendered or are rendered may be provided to the data driver 12. In addition, the timing controller 11 may provide the control signals to the data driver 12, the scan driver 13, the light emitting driver 14, and the like to display a frame.

The data driver 12 may generate data voltages to be provided to data lines D1, D2, D3, and Dn using the grayscale values and the control signals. For example, the data driver 12 may sample the grayscale values using a clock signal, and apply the data voltages corresponding to the grayscale values to the data lines D1 to Dn in units of pixel rows, where n may be an integer greater than zero.

The scan driver 13 may receive a clock signal, a scan start signal, and the like from the timing controller 11 to generate scan signals to be provided to scan lines S1, S2, S3, and Sm, where m may be an integer greater than zero.

The scan driver 13 may sequentially supply the scan signals having a pulse of a turn-on level to the scan lines S1, S2, S3, and Sm. The scan driver 13 may include scan stages configured in a form of shift registers. The scan driver 13 may generate the scan signals in a manner of sequentially transferring the scan start signal, which is a pulse form of a turn-on level, to a next scan stage under control of the clock signal.

The light emitting driver 14 may receive a clock signal, a light emitting stop start signal, and the like from the timing controller 11 to generate light emitting signals to be provided to light emitting lines E1, E2, E3, and Eo. For example, the light emitting driver 14 may sequentially provide light emitting signals having a pulse of a turn-off level to the light emitting lines E1 to Eo. For example, each light emitting stage of the light emitting driver 14 may be configured in a form of a shift register, and may generate the light emitting signals in a manner of sequentially transferring the light emitting stop start signal, which is a pulse form of a turn-off level, to a next light emitting stage under control of the clock signal, where o may be an integer greater than zero.

The pixel unit 15 includes pixels. Each pixel PXij may be connected to a corresponding data line, scan line, and light emitting line, where i and j may be natural numbers. The pixel PXij may refer to a pixel where a scan transistor is connected to an i-th scan line and a j-th data line. For example, a scan input terminal of the pixel PXij may be connected to the i-th scan line, and a data input terminal of the pixel PXij may be connected to the j-th data line.

Figure 2:
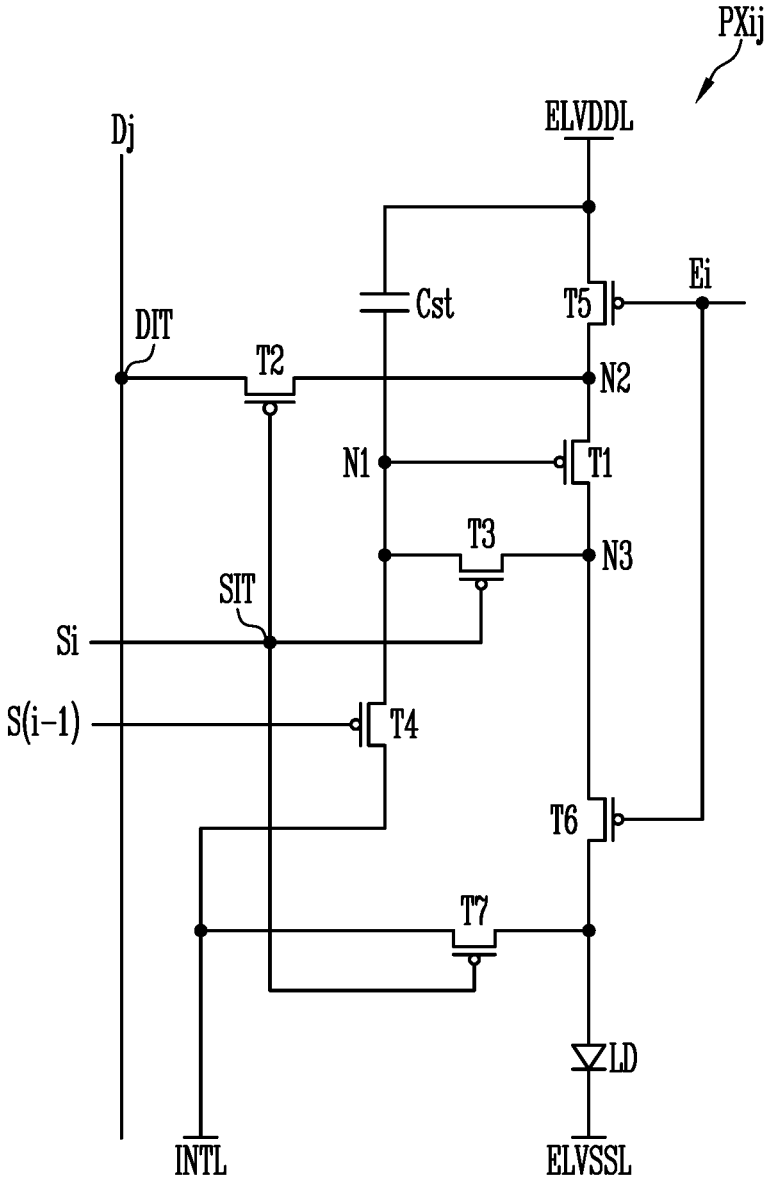
FIG. 2 is a diagram for describing a pixel according to an embodiment of the disclosure.

FIG. 2 is a diagram for describing a pixel according to an embodiment of the disclosure.

Referring to FIG. 2, the pixel PXij includes transistors T1, T2, T3, T4, T5, T6, and T7, a storage capacitor Cst, and a light emitting diode LD.

Hereinafter, a circuit configured as a p-type transistor (p-channel transistor) will be described as an example. However, those skilled in the art will be able to design a circuit configured as an n-type transistor (n-channel transistor) by differentiating a polarity of a voltage applied to a gate terminal. Similarly, those skilled in the art will be able to design a circuit configured as a combination of a p-type transistor and an n-type transistor. The p-type transistors are collectively referred to as transistors in which an amount of a conducted current increases when a voltage difference between a gate electrode and a source electrode increases in a negative direction. The n-type transistors are collectively referred to as transistors in which an amount of conducted current increases when a voltage difference between a gate electrode and a source electrode increases in a positive direction. The transistor may be configured in various suitable forms such as a thin film transistor (TFT), a field effect transistor (FET), and a bipolar junction transistor (BJT).

The first transistor T1 may have a gate electrode connected to a first node N1, a first electrode connected to a second node N2, and a second electrode connected to a third node N3. The first transistor T1 may be referred to as a driving transistor.

The second transistor T2 may have a gate electrode connected to the i-th scan line Si, a first electrode connected to the data line Dj, and a second electrode connected to the second node N2. The second transistor T2 may be referred to as a scan transistor. The first electrode of the second transistor T2 may be a data input terminal DIT of the pixel PXij. In addition, the gate electrode of the second transistor T2 may be a scan input terminal SIT of the pixel PXij.

The third transistor T3 may have a gate electrode connected to the i-th scan line Si, a first electrode connected to the first node N1, and a second electrode connected to the third node N3. The third transistor T3 may be referred to as a diode-connected transistor.

The fourth transistor T4 may have a gate electrode connected to an S(i−1)-th scan line S(i−1), a first electrode connected to the first node N1, and a second electrode connected to an initialization line INTL. In an embodiment, the gate electrode of the fourth transistor T4 may be connected to another scan line. The fourth transistor T4 may be referred to as a gate initialization transistor.

The fifth transistor T5 may have a gate electrode connected to the i-th light emitting line Ei, a first electrode connected to a first power line ELVDDL, and a second electrode connected to the second node N2. The fifth transistor T5 may be referred to as a light emitting transistor. In an embodiment, the gate electrode of the fifth transistor T5 may be connected to another light emitting line.

The sixth transistor T6 may have a gate electrode connected to the i-th light emitting line Ei, a first electrode connected to the third node N3, and a second electrode connected to an anode of the light emitting diode LD. The sixth transistor T6 may be referred to as a light emitting transistor. In an embodiment, the gate electrode of the sixth transistor T6 may be connected to another light emitting line.

The seventh transistor T7 may have a gate electrode connected to the i-th scan line Si, a first electrode connected to the initialization line INTL, and a second electrode connected to the anode of the light emitting diode LD. The seventh transistor T7 may be referred to as an anode initialization transistor. In an embodiment, the gate electrode of the seventh transistor T7 may be connected to another scan line.

A first electrode of the storage capacitor Cst may be connected to the first power line ELVDDL, and a second electrode may be connected to the first node N1.

The anode of the light emitting diode LD may be connected to the second electrode of the sixth transistor T6, and a cathode may be connected to a second power line ELVSSL. The light emitting diode LD may be configured as an organic light emitting diode, an inorganic light emitting diode, a quantum dot light emitting diode, or the like.

The first power line ELVDDL may be supplied with a first power voltage, the second power line ELVSSL may be supplied with a second power voltage, and the initialization line INTL may be supplied with an initialization voltage. In an embodiment, the first power voltage may be greater than the second power voltage. In an embodiment, the initialization voltage may be equal to or greater than the second power voltage.

Figure 3:
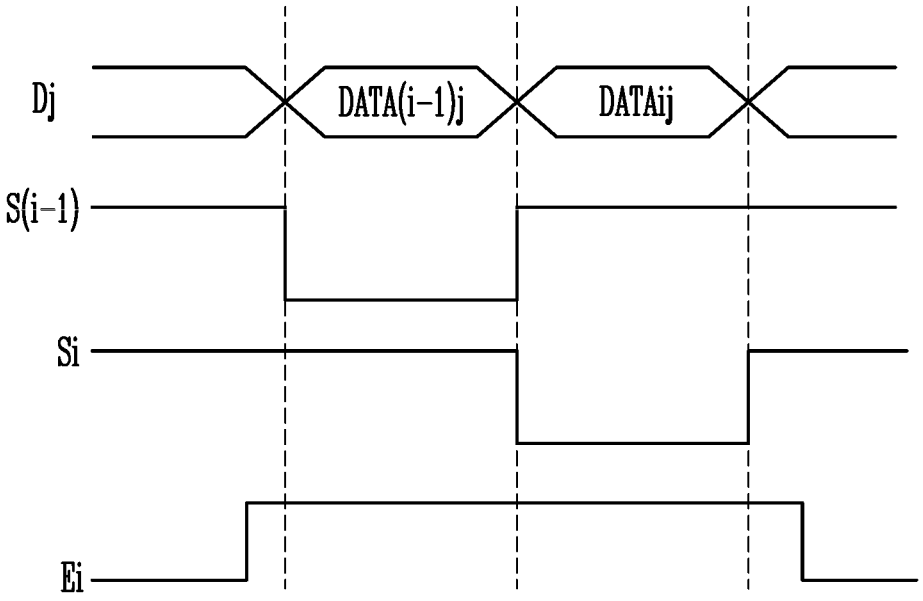
FIG. 3 is a diagram for describing a method of driving a pixel according to an embodiment of the disclosure.

FIG. 3 is a diagram for describing a method of driving a pixel according to an embodiment of the disclosure.

First, a data voltage DATA(i−1)j for an (i−1)-th pixel is applied to the data line Dj, and a scan signal of a turn-on level (low level) is applied to the (i−1)-th scan line S(i−1).

In an embodiment, because a scan signal of a turn-off level (high level) is applied to the i-th scan line Si, the second transistor T2 is turned off, and the data voltage DATA(i−1)j is prevented from being drawn into the pixel PXij.

In an embodiment, because the fourth transistor T4 is turned on, the first node N1 is connected to the initialization line INTL, and a voltage of the first node N1 is initialized. Because the light emitting signal of the turn-off level is applied to the light emitting line Ei, the transistors T5 and T6 are turned off, and a light emission of an light emitting diode LD according to an initialization voltage application process is prevented or reduced.

Next, a data voltage DATAij for the i-th pixel PXij is applied to the data line Dj, and the scan signal of the turn-on level is applied to the i-th scan line Si. Therefore, the transistors T2, T1, and T3 are turned on, and the data line Dj and the first node N1 are electrically connected with each other. Thus, a compensation voltage obtained by subtracting a threshold voltage of the first transistor T1 from the data voltage DATAij is applied to the second electrode of the storage capacitor Cst (i.e., the first node N1), and the storage capacitor Cst maintains a voltage corresponding to a difference between the first power voltage and the compensation voltage. Such a period may be referred to as a threshold voltage compensation period.

In an embodiment, because the seventh transistor T7 is turned on, the anode of the light emitting diode LD and the initialization line INTL are connected with each other, and the light emitting diode LD is initialized to a charge amount corresponding to a voltage difference between the initialization voltage and the second power voltage.

Thereafter, as the light emitting signal of the turn-on level is applied to the light emitting line Ei, the transistors T5 and T6 may be turned on. Therefore, a driving current path is formed as a path of the first power line ELVDDL, the fifth transistor T5, the first transistor T1, the sixth transistor T6, the light emitting diode LD, and the second power line ELVSSL.

A driving current amount flowing to the first electrode and the second electrode of the first transistor T1 is adjusted according to the voltage maintained in the storage capacitor Cst. The light emitting diode LD emits light at a luminance corresponding to the driving current amount. The light emitting diode LD emits light until the light emitting signal of the turn-off level is applied to the light emitting line Ei.

Figure 4:
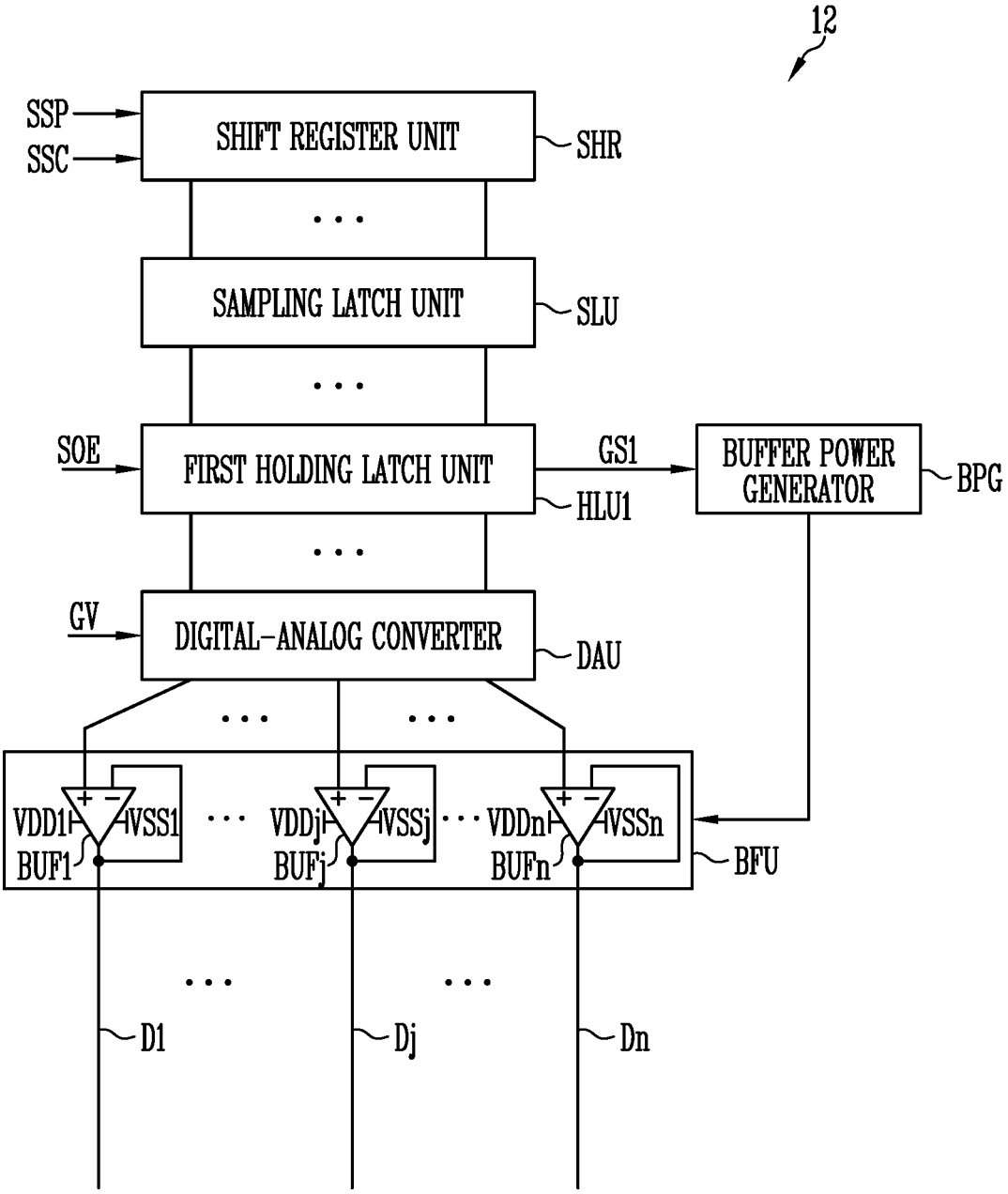
FIG. 4 is a diagram for describing a data driver according to an embodiment of the disclosure.

FIG. 4 is a diagram for describing a data driver according to an embodiment of the disclosure.

Referring to FIG. 4, the data driver 12 according to an embodiment of the disclosure includes a shift register unit SHR, a sampling latch unit SLU, a first holding latch unit HLU1, a digital-analog converter DAU, a buffer unit BFU, and a buffer power generator BPG. According to an embodiment, the buffer power generator BPG may be present outside the data driver 12.

The shift register unit SHR may receive a source start pulse SSP and a source shift clock SSC from the timing controller 11. The shift register unit SHR may sequentially generate sampling signals while shifting the source start pulse SSP every one period of the source shift clock SSC. The number of the sampling signals may correspond to the number of the data lines D1, Dj, and Dn. For example, the number of the sampling signals may be the same as the number of the data lines D1, Dj, and Dn. In an embodiment, the display device 10 further includes a de-multiplexer between the data driver 12 and the data lines D1, Dj, and Dn, and the number of the sampling signals may be less than the number of the data lines D1, Dj, and Dn. For convenience of description, in the following description, it is assumed that there is no de-multiplexer.

The sampling latch unit SLU may include sampling latches of the number corresponding to the number of the data lines D1, Dj, and Dn, and may sequentially receive the grayscale values (or gray level values) of the image frame from the timing controller 11. The sampling latch unit SLU may store the grayscale values that are sequentially supplied from the timing controller 11 in corresponding sampling latches in response to the sampling signals sequentially supplied from the shift register unit SHR.

A first holding latch unit HLU1 may include first holding latches of the number corresponding to the number of the data lines D1, Dj, and Dn. The first holding latch unit HLU1 may store the grayscale values stored in the sampling latches in first holding latches when a source output enable signal SOE is input from the timing controller 11.

The digital-analog converter DAU may include digital-to-analog converters of the number corresponding to the number of the data lines D1, Dj, and Dn. For example, the number of the digital-to-analog converters may be the same as the number of the data lines D1, Dj, and Dn. Each of the digital-analog converters may apply a grayscale voltage (or gray voltage) GV corresponding to the grayscale value stored in the corresponding holding latch to the corresponding data line.

The grayscale voltage GV may be provided from a grayscale voltage generator. The grayscale voltage generator may include a red grayscale voltage generator, a green grayscale voltage generator, and a blue grayscale voltage generator. In an embodiment, the grayscale voltage GV may be set so that a luminance corresponding to each grayscale (or each gray level) follows a gamma curve. The gamma curve will be further described with reference to FIGS. 7 and 9.

The buffer unit BFU may include amplifiers BUF1, BUFj, and BUFn. For example, each of the amplifiers BUF1, BUFj, and BUFn may be an operational amplifier. Each of the amplifiers BUF1, BUFj, and BUFn may be configured in a form of a voltage follower to apply an output of the digital-to-analog converter to the corresponding data lines D1, Dj, and Dn. For example, an inverting terminal of each of the amplifiers BUF1, BUFj, and BUFn may be connected to its own output terminal, and a non-inverting terminal may be connected to an output terminal of the digital-to-analog converter. The outputs of the amplifiers BUF1, BUFj, and BUFn may be the data voltages.

The first amplifier BUF1 may have an output terminal connected to the first data line D1 and may be connected to first high voltage power source VDD1 and first low voltage power source VSS1. The first high voltage power source VDD1 may determine an upper limit of an output voltage (i.e., the data voltage) of the first amplifier BUF1. In addition, the first low voltage power source VSS1 may determine a lower limit of the output voltage of the first amplifier BUF1. Other voltages other than the first high voltage power source VDD1 and the first low voltage power source VSS1 may be further applied to the first amplifier BUF1 according to a configuration thereof. Such other voltages may be control voltages that determine a slew rate of the first amplifier BUF1. Such control voltages are different from the first high voltage power source VDD1 and the first low voltage power source VSS1 in that the control voltages are not voltages that determine the upper limit or the lower limit of the output voltage of the first amplifier BUF1. Hereinafter, repetitive description of other high voltage power source and low voltage power source will be omitted. The data input terminal of a first pixel may be connected to the first data line D1.

The second amplifier BUFj may have an output terminal connected to the second data line Dj and may be connected to second high voltage power source VDDj and second low voltage power source VSSj. The second high voltage power source VDDj and the second low voltage power source VSSj may determine an upper limit and a lower limit of an output voltage of the second amplifier BUFj, respectively. A data input terminal of a second pixel may be connected to the second data line Dj.

The buffer power generator BPG may include the high voltage power source VDD1, VDDj, VDDn and the low voltage power source VSS1, VSSj, VSSn. The buffer power generator BPG may receive grayscale values GS1 corresponding to one scan line from the first holding latch unit HLU1.

In an embodiment, the buffer power generator BPG may receive the grayscale values GS1 from a line memory other than the first holding latch unit HLU1. Such a line memory may be located in the data driver 12, the timing controller 11, or elsewhere. In an embodiment, the buffer power generator BPG may receive the grayscale values GS1 from the sampling latch unit SLU. In an embodiment, the buffer power generator BPG may directly receive the grayscale values GS1 from the timing controller 11. The buffer power generator BPG may receive the grayscale values GS1 using various suitable methods when the voltages of the high voltage power source and the low voltage power source determined in the buffer power generator BPG may be synchronized with the output of the corresponding data voltages and supplied to the amplifiers BUF1, BUFj, and BUFn.

According to an embodiment, the first low voltage power source VSS1 and the second low voltage power source VSSj may be independent power sources. That is, a voltage of the first low voltage power source VSS1 and a voltage of the second low voltage power source VSSj may be set to be different from each other or may be set to be the same. The buffer power generator BPG may determine the first low voltage power source VSS1 with reference to (or based on) a first grayscale value for a first pixel. In addition, the buffer power generator BPG may determine the second low voltage power source VSSj with reference to (or based on) a second grayscale value for a second pixel. The present embodiment will be described later in more detail with reference to FIGS. 6 and 7.

In addition, according to an embodiment, the first high voltage power source VDD1 and the second high voltage power source VDDj may be independent power sources. That is, a voltage of the first high voltage power source VDD1 and a voltage of the second high voltage power source VDDj may be set to be different from each other or set to be the same. The buffer power generator BPG may determine the first high voltage power source VDD1 with reference to the first grayscale value for the first pixel. In addition, the buffer power generator BPG may determine the second high voltage power source VDDj with reference to the second grayscale value for the second pixel. The present embodiment will be described later in more detail with reference to FIGS. 8 and 9.

In addition, according to an embodiment, the first low voltage power source VSS1 and the second low voltage power source VSSj may be independent power sources and the first high voltage power source VDD1 and the second high voltage power source VDDj may be independent power sources. The present embodiment will be described later in more detail with reference to FIG. 10.

Figure 5:
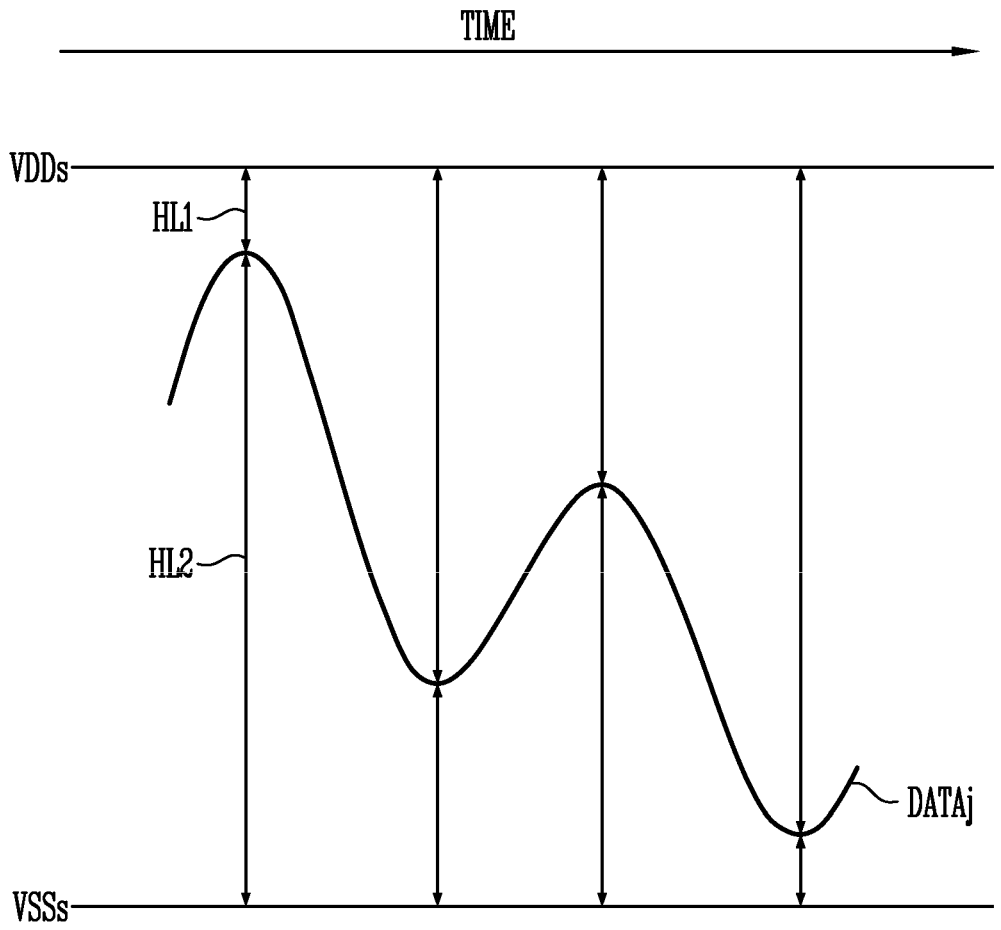
FIG. 5 is a diagram for describing heat loss of an amplifier.

FIG. 5 is a diagram for describing heat loss of the amplifier.

Referring to FIG. 5, it is assumed that the same high voltage power source VDDs and low voltage power source VSSs are connected to all the amplifiers BUF1, BUFj, and BUFn of the buffer unit BFU, in a manner different from the embodiments of the disclosure.

The amplifiers BUF1, BUFj, and BUFn may output data voltages that are each equal to or less than a voltage of the high voltage power source VDDs and equal to or greater than a voltage of the low voltage power source VSSs. For example, the amplifier BUFj may output a data voltage DATAj corresponding to a grayscale value of each horizontal period to the data line Dj. One horizontal period may be a period allocated to write a data voltage to pixels to which the scan input terminals are connected to one scan line.

Power consumption may occur according to first heat loss HL1 according to a voltage difference between the data voltage DATAj and the high voltage power source VDDs during each horizontal period. In addition, power consumption may occur according to second heat loss HL2 according to a voltage difference between the data voltage DATAj and the low voltage power source VSSs during each horizontal period.

Figure 6:
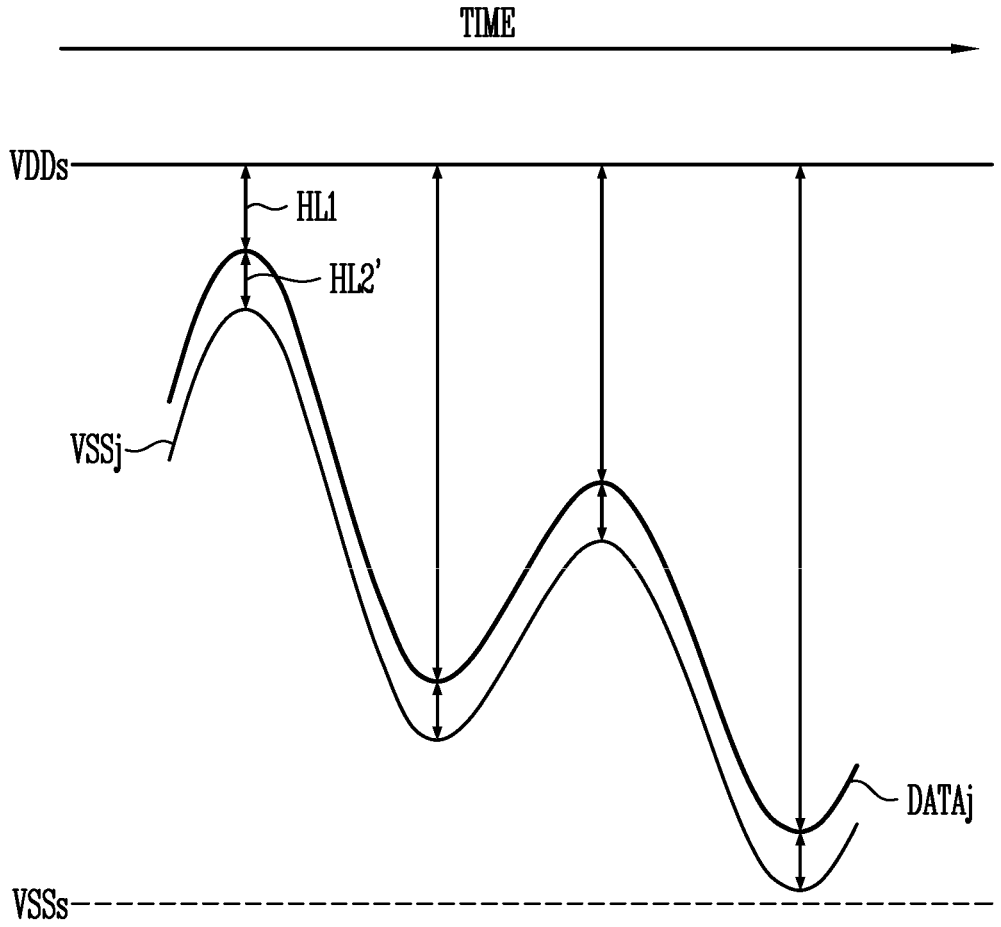
FIG. 6 is a diagram for describing a case in which low voltage power source of an amplifier is controlled according to an embodiment of the disclosure.

FIG. 6 is a diagram for describing a case in which low voltage power source of an amplifier is controlled according to an embodiment of the disclosure.

According to an embodiment, the first low voltage power source VSS1 and the second low voltage power source VSSj may be independent power sources. That is, the voltage of the first low voltage power source VSS1 and the voltage of the second low voltage power source VSSj may be set to be different from each other or may be set to be the same. The buffer power generator BPG may determine the first low voltage power source VSS1 with reference to the first grayscale value for the first pixel. In addition, the buffer power generator BPG may determine the second low voltage power source VSSj with reference to the second grayscale value for the second pixel.

According to an embodiment, a voltage difference between the first low voltage power source VSS1 and the first data voltage output from the first amplifier BUF1 in correspondence with (or based on) the first grayscale value may correspond to a voltage difference between the second low voltage power source VSSj and the second data voltage output from the second amplifier BUFj in correspondence with (or based on) the second grayscale value. Because it is desirable for the data voltage to be higher than the voltage of the low voltage power source, a margin of difference between the data voltage and the voltage of the low voltage power source is desirable. Such a margin may be set to the same for each of the amplifiers BUF1, BUFj, and BUFn of the buffer unit BFU.

It may be confirmed that second heat loss HL2' in the embodiment of FIG. 6 is less than the second heat loss HL2 in FIG. 5. Therefore, a power consumption reduction effect of the display device 10 may be exhibited.

Figure 7:
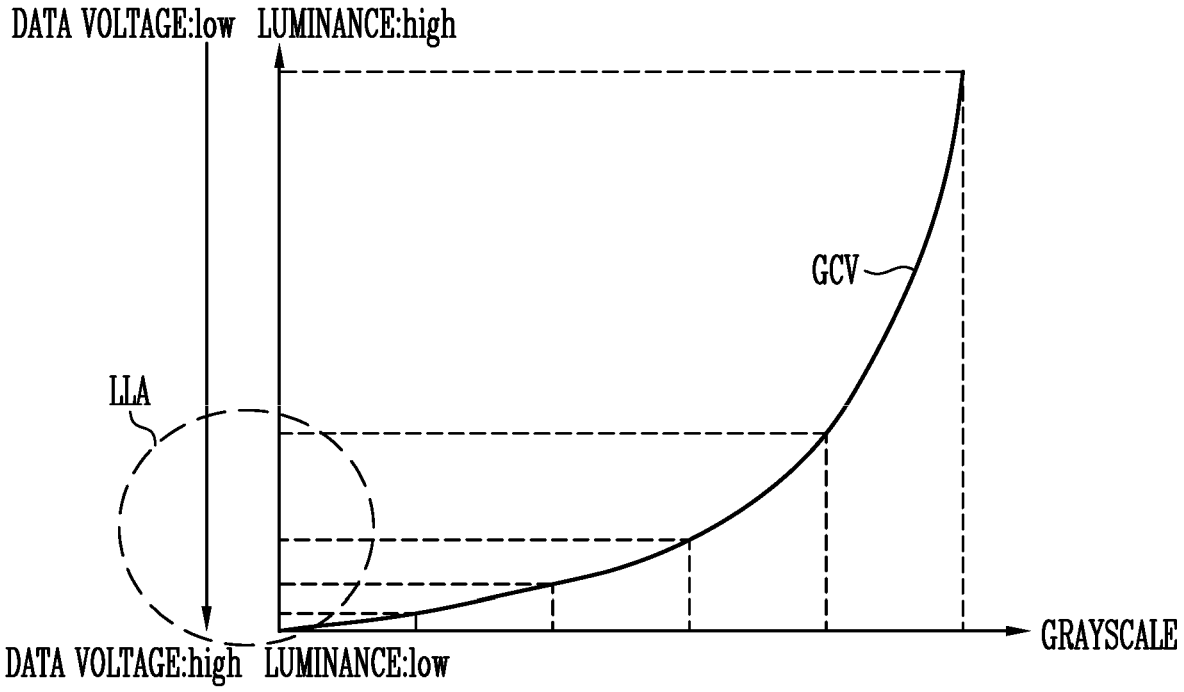
FIG. 7 is a diagram for describing a case according to the embodiment of FIG. 6.

FIG. 7 is a diagram for describing a case according to the embodiment of FIG. 6.

In the embodiment of FIG. 6, the first transistor T1 of the pixel PXij (i.e., the driving transistor) may be configured as a p-type transistor. For example, the first pixel may include a p-type transistor having a gate electrode to which the first data voltage output from the first amplifier BUF1 is applied. In addition, the second pixel may include a p-type transistor having the gate electrode to which the second data voltage output from the second amplifier BUFj is applied.

Referring to FIG. 7, a gamma curve GCV showing a luminance for each grayscale value is shown. The gamma curve GCV is used to compensate for a non-linearity of a brightness of human vision. A gamma value of the gamma curve GCV, (e.g., 2.0 gamma, 2.2. gamma, or 2.4 gamma) may be different according to the display device 10. In addition, according to an embodiment, a user may set the gamma value of the gamma curve GCV.

When the driving transistor of the pixel PXij is configured as the p-type transistor, a higher data voltage is desirable as a lower luminance is expressed. As shown in FIG. 7, when the grayscales (or gray levels) are divided into equal intervals, it may be confirmed that most of grayscales are concentrated in a low luminance area LLA by a shape of the gamma curve GCV. Therefore, when the driving transistor of the pixel PXij is configured as the p-type transistor, the second heat loss HL2 is dominant in comparison with the first heat loss HL1.

Therefore, the buffer power unit BPG may supply the same high voltage power source VDDs to the first amplifier BUF1 and the second amplifier BUFj and supply the independent low voltage power source VSS1 and VSSj to minimize or reduce the second heat loss HL2'.

In order to implement this, when the driving transistor is configured as the p-type transistor, the buffer power generator BPG may determine the voltage of the first low voltage power source VSS1 to be less as the first grayscale value is greater and determine the voltage of the first low voltage power source VSS1 to be greater as the first grayscale value is less. That is, the buffer power generator BPG may determine that the voltage of the first low voltage power source VSS1 is lesser in value when the first grayscale value becomes greater in value and may determine that the voltage of the first low voltage power source VSS1 is greater in value when the first grayscale value becomes lesser in value. Similarly the buffer power generator BPG may determine the voltage of the second low voltage power source VSSj to be less as the second grayscale value is greater and determine the voltage of the second low voltage power source VSSj to be greater as the second grayscale value is less. That is, the buffer power generator BPG may determine that the voltage of the second low voltage power source VSSj is lesser in value when the second grayscale value becomes greater in value and determine that the voltage of the second low voltage power source VSSj is greater in value when the second grayscale value becomes lesser in value.

Figure 8:
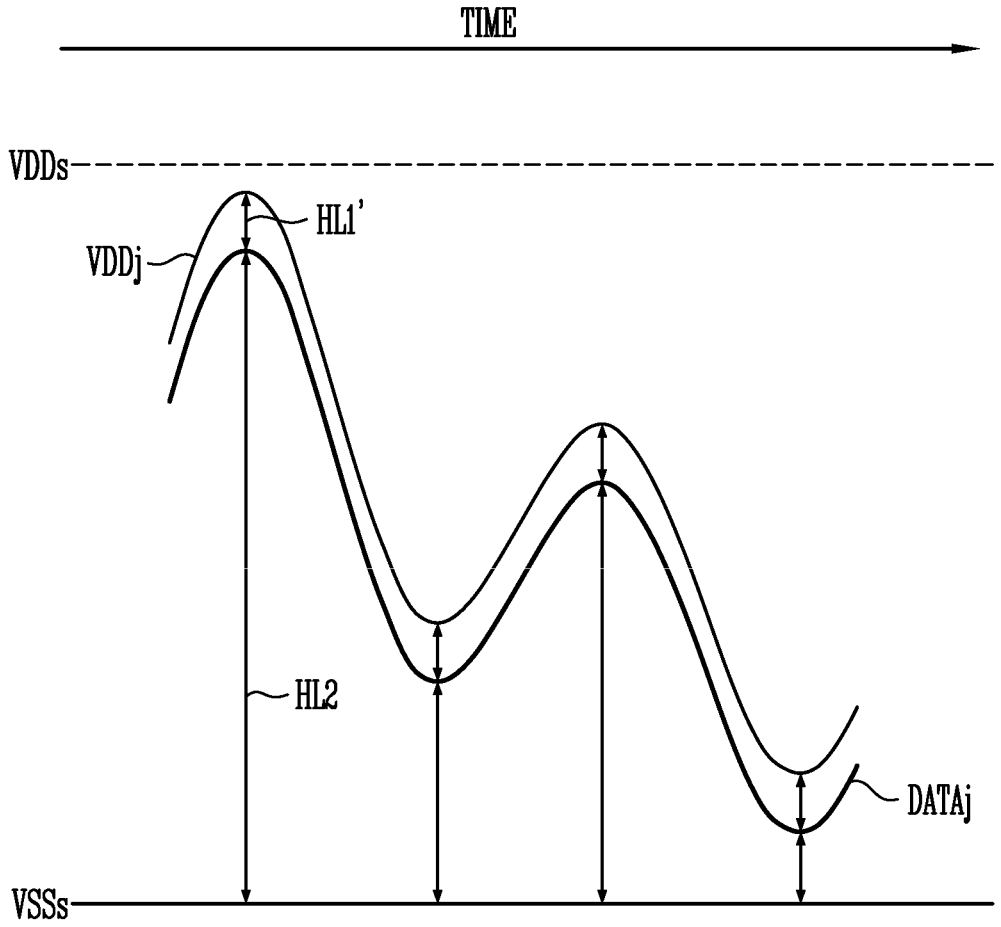
FIG. 8 is a diagram for describing a case in which high voltage power source of an amplifier is controlled according to an embodiment of the disclosure.

FIG. 8 is a diagram for describing a case in which high voltage power source of an amplifier is controlled according to an embodiment of the disclosure.

According to an embodiment, the first high voltage power source VDD1 and the second high voltage power source VDDj may be independent power sources. That is, the voltage of the first high voltage power source VDD1 and the voltage of the second high voltage power source VDDj may be set to be different from each other or set to be the same. The buffer power generator BPG may determine the first high voltage power source VDD1 with reference to the first grayscale value for the first pixel. In addition, the buffer power generator BPG may determine the second high voltage power source VDDj with reference to the second grayscale value for the second pixel.

According to an embodiment, a voltage difference between the first high voltage power source VDD1 and the first data voltage output from the first amplifier BUF1 in correspondence with the first grayscale value may correspond to a voltage difference between the second high voltage power source VDDj and the second data voltage output from the second amplifier BUFj in correspondence with the second grayscale value. Because it is desirable for the data voltage to be less than the voltage of the high voltage power source, a margin of difference between the data voltage and the voltage of the high voltage power source is desirable. Such a margin may be set to the same for each of the amplifiers BUF1, BUFj, and BUFn of the buffer unit BFU.

It may be confirmed that the first heat loss HL1' in the embodiment of FIG. 8 is less than the first heat loss HL1 in FIG. 5. Therefore, the power consumption reduction effect of the display device 10 may be exhibited.

Figure 9:
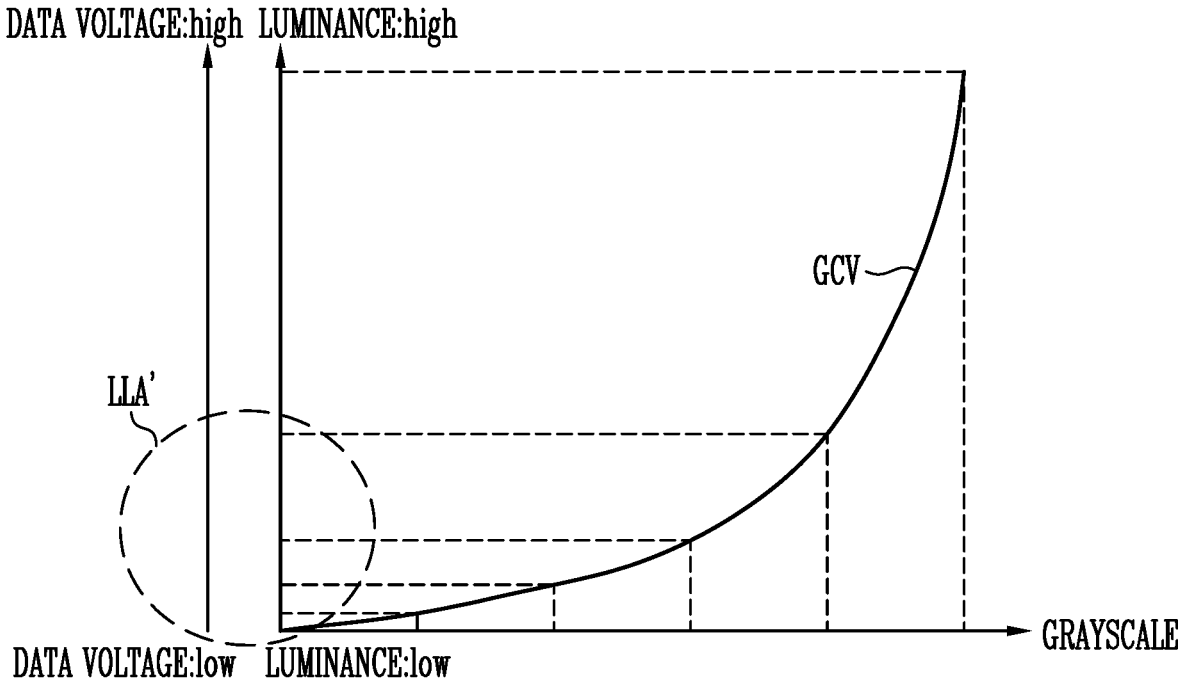
FIG. 9 is a diagram for describing a case according to the embodiment of FIG. 8.

FIG. 9 is a diagram for describing a case according to the embodiment of FIG. 8.

In the embodiment of FIG. 8, the driving transistor of the pixel PXij may be configured as an n-type transistor. For example, the first pixel may include an n-type transistor having a gate electrode to which the first data voltage output from the first amplifier BUF1 is applied. In addition, the second pixel may include an n-type transistor having a gate electrode to which the second data voltage output from the second amplifier BUFj is applied.

Referring to FIG. 9, a gamma curve GCV showing a luminance for each grayscale value is shown. The gamma curve GCV is used to compensate for a non-linearity of a brightness of human vision. A gamma value of the gamma curve GCV, (e.g., 2.0 gamma, 2.2. gamma, or 2.4 gamma) may be different according to the display device 10. In addition, according to an embodiment, a user may set the gamma value of the gamma curve GCV.

When the driving transistor of the pixel PXij is configured as the n-type transistor, a lower data voltage is desirable as a lower luminance is expressed. As shown in FIG. 9, when the grayscales are divided into equal intervals, it may be confirmed that most of grayscales are concentrated in a low luminance area LLA' by a shape of the gamma curve GCV. Therefore, when the driving transistor of the pixel PXij is configured as the n-type transistor, the first heat loss HL2 is dominant in comparison with the second heat loss HL2.

Therefore, the buffer power unit BPG may supply the same low voltage power source VSSs to the first amplifier BUF1 and the second amplifier BUFj and supply the independent high voltage power source VDD1 and VDDj to minimize or reduce the first heat loss HL1'.

In order to implement this, when the driving transistor is configured as the n-type transistor, the buffer power generator BPG may determine the voltage of the first high voltage power source VDD1 to be greater as the first grayscale value is greater and determine the voltage of the first high voltage power source VDD1 to be less as the first grayscale value is less. That is, the buffer power generator BPG may determine that the voltage of the first high voltage power source VDD1 is greater in value when the first grayscale value becomes greater in value and may determine that the voltage of the first high voltage power source VDD1 is lesser in value when the first grayscale value becomes lesser in value. Similarly the buffer power generator BPG may determine the voltage of the second high voltage power source VDDj to be greater as the second grayscale value is greater and determine the voltage of the second high voltage power source VDDj to be less as the second grayscale value is less. That is, the buffer power generator BPG may determine that the voltage of the second high voltage power source VDDj is greater in value when the first grayscale value becomes greater in value and may determine that the voltage of the second high voltage power source VDDj is lesser in value when the first grayscale value becomes lesser in value.

Figure 10:
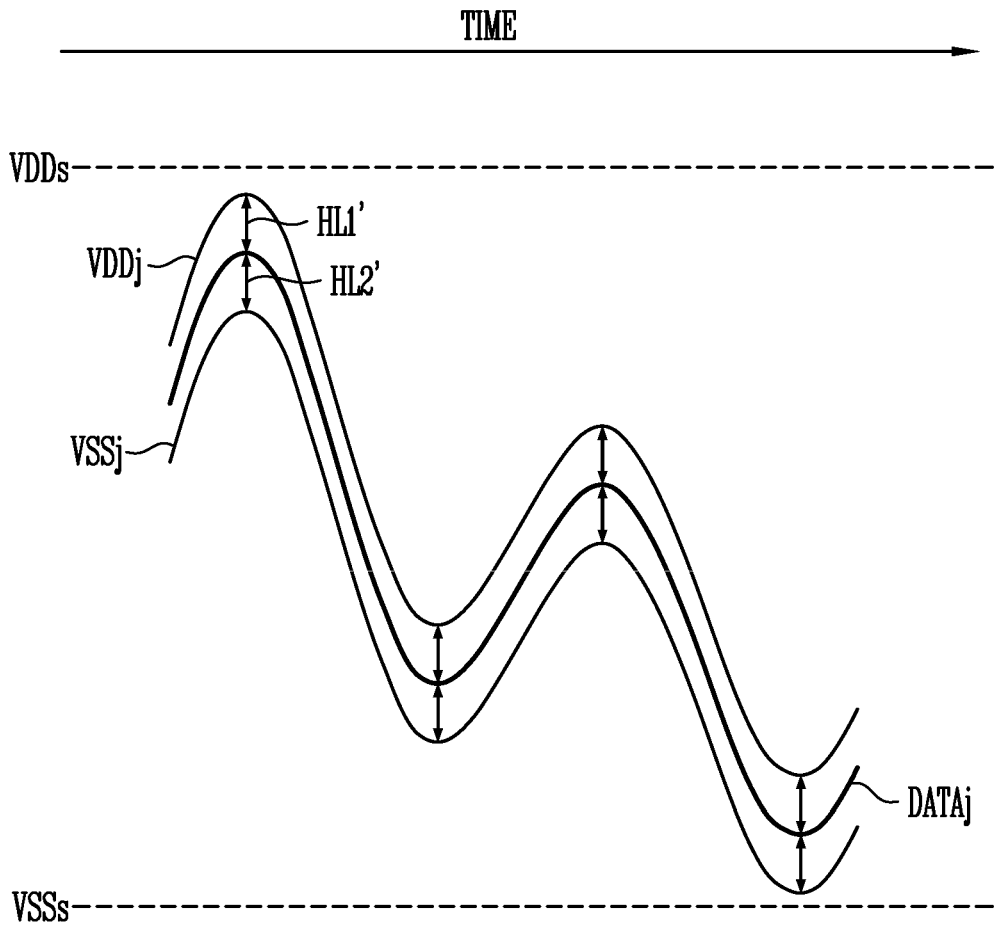
FIG. 10 is a diagram for describing a case in which high voltage power source and low voltage power source of an amplifier are controlled according to an embodiment of the disclosure.

FIG. 10 is a diagram for describing a case in which high voltage power source and low voltage power source of an amplifier are controlled according to an embodiment of the disclosure.

Referring to FIG. 10, an embodiment in which the buffer power generator BPG provides independent high voltage power source and independent low voltage power source is shown. The description repetitive to the description with reference to FIGS. 6-9 will be omitted.

According to the present embodiment, the first heat loss HL1' and the second heat loss HL2' may be minimized or reduced regardless of the type (p-type or n-type) of the driving transistor of the pixel PXij.

Figure 11:
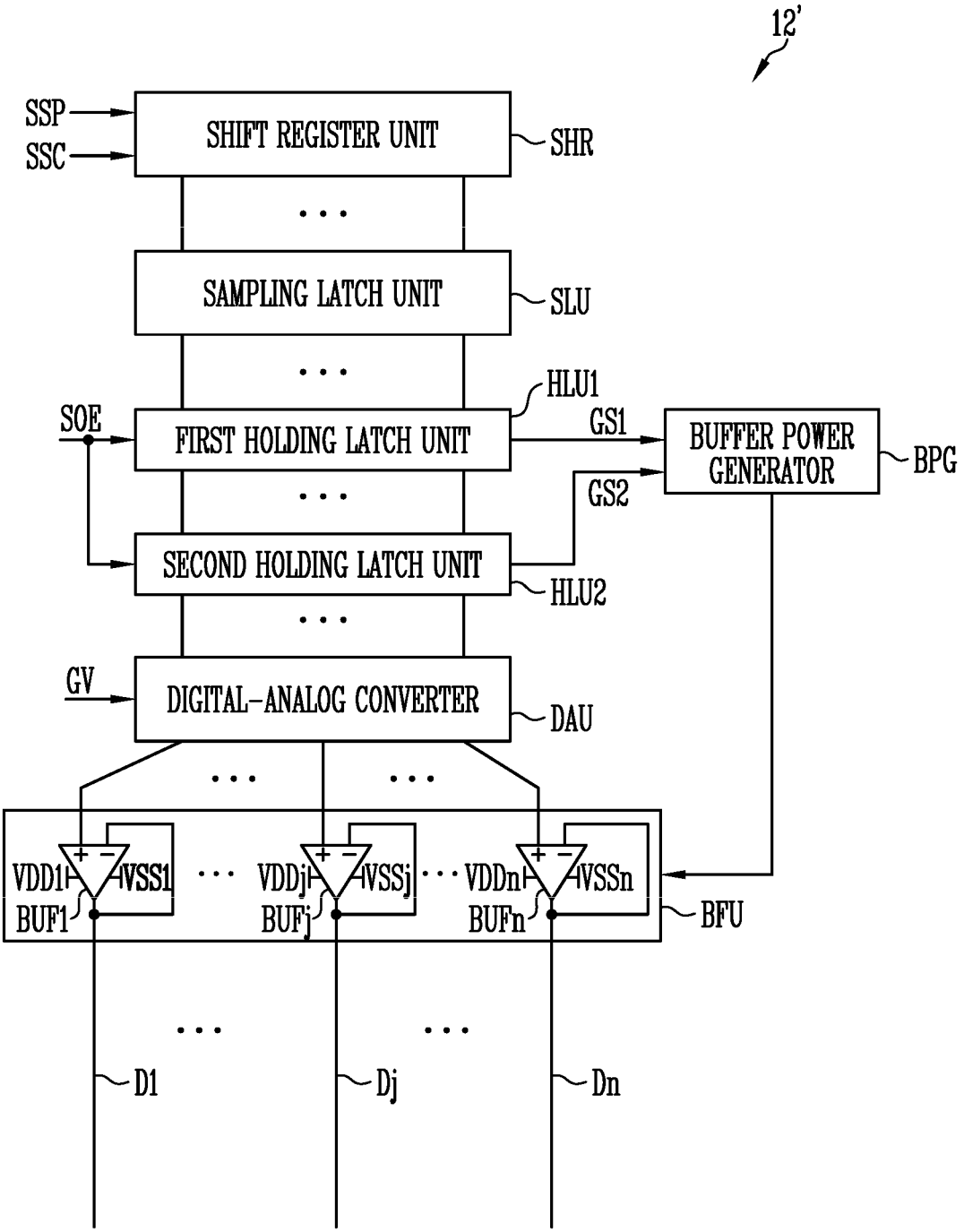
FIG. 11 is a diagram for describing a data driver according to an embodiment of the disclosure.

FIG. 11 is a diagram for describing a data driver according to an embodiment of the disclosure.

The data driver 12' of FIG. 11 further includes a second holding latch HLU2 in comparison with the data driver 12 of FIG. 4. The repetitive description for the repetitive configuration of FIG. 4 will be omitted.

The second holding latch unit HLU2 may include second holding latches of the number corresponding to the number of the data lines D1, Dj, and Dn. The second holding latch unit HLU2 may store the grayscale values stored in the first holding latches of the first holding latch unit HLU1 when the source output enable signal SOE is input from the timing controller 11.

The buffer power generator BPG may receive grayscale values GS2 corresponding to one scan line from the second holding latch unit HLU2. In addition, the buffer power generator BPG may receive the grayscale values GS1 corresponding to one scan line one horizontal period before the grayscale values GS2 from the first holding latch unit HLU1. Therefore, the buffer power generator BPG may determine the voltages of the high voltage power source VDD1, VDDj, and VDDn and the low voltage power source VSS1, VSSj, and VSSn with reference to the grayscale values GS1 and GS2 corresponding to the two scan lines (i.e., corresponding to two horizontal periods).

In an embodiment, the buffer power generator BPG may determine a magnitude of the voltage of the first low voltage power source VSS1 based on a maximum or larger grayscale value of the two grayscale values corresponding to two horizontal periods with respect to the first data line D1. Similar to the case of FIGS. 6 and 7, the present embodiment may be advantageous in reducing heat loss when the driving transistor of the pixel PXij is a p-type transistor.

In an embodiment, the buffer power generator BPG may determine a magnitude of the voltage of the first high voltage power source VDD1 based on the maximum grayscale value of the two grayscale values corresponding to the two horizontal periods with respect to the first data line D1. Similar to the case of FIGS. 8 and 9, the present embodiment may be advantageous in reducing heat loss when the driving transistor of the pixel PXij is an n-type transistor.

In an embodiment, the buffer power generator BPG may determine magnitudes of the voltages of the first low voltage power source VSS1 and the first high voltage power source VDD1 based on the maximum or larger grayscale value of the two grayscale values corresponding to the two horizontal periods with respect to the first data line D1. Similar to the case of FIG. 10, the present embodiment may reduce heat loss regardless of the type of the driving transistor of the pixel PXij.

The above-described embodiments may be applied to each of the other data lines Dj and Dn. Meanwhile, the above-described embodiments may be applied to each of groups of the data lines D1, Dj, and Dn.

Figure 12:
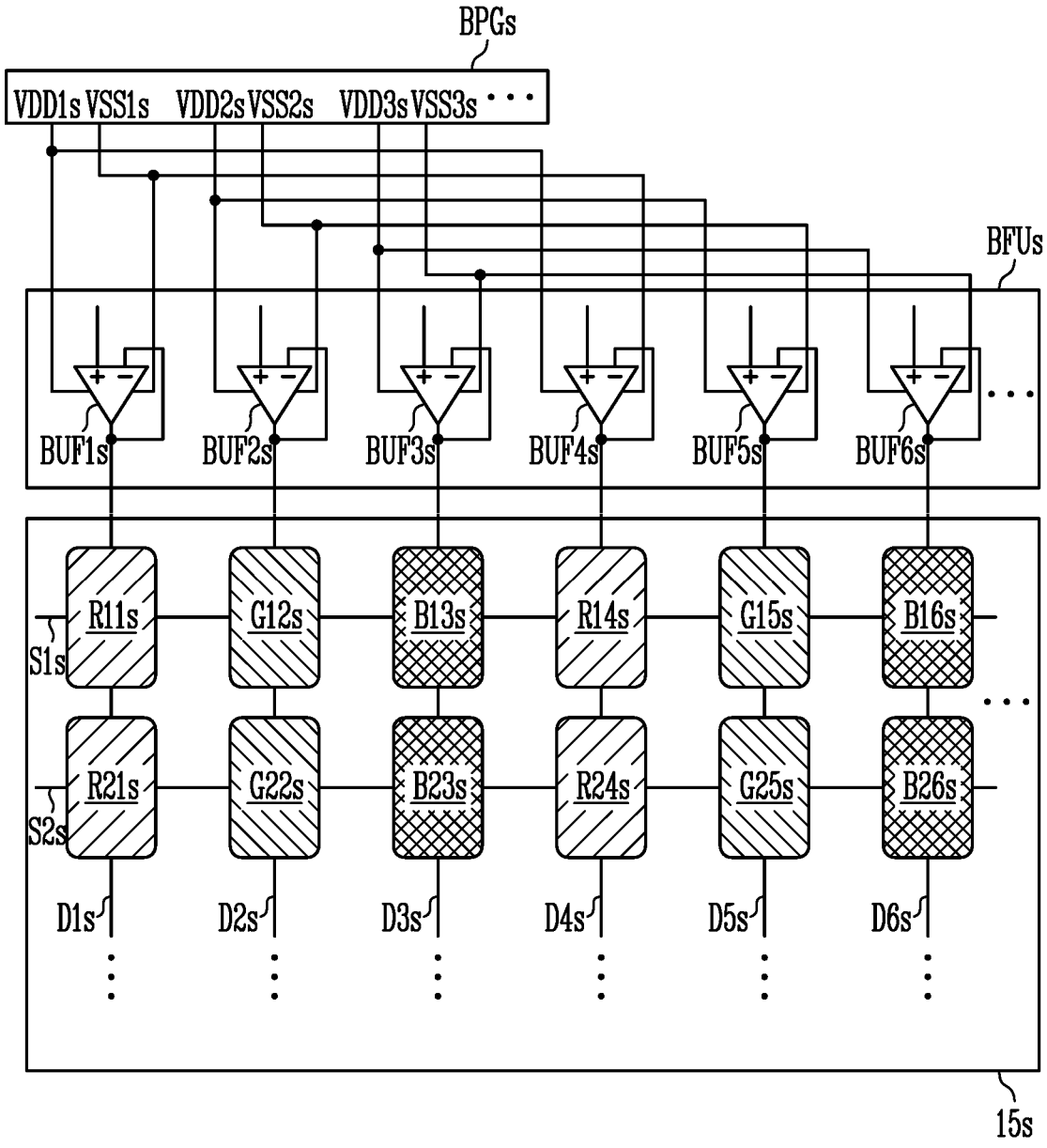
FIG. 12 is a diagram for describing an embodiment of the disclosure, which is applicable when a pixel unit is configured in an RGB stripe structure.

FIG. 12 is a diagram for describing an embodiment of the disclosure, which is applicable when a pixel unit is configured in an RGB stripe structure.

Referring to FIG. 12, the pixel unit 15*s* includes pixels R11*s* to B26*s* arranged in an RGB stripe structure.

The first pixel R11*s* may have a data input terminal connected to a first data line D1*s*. The second pixel G12*s* may have a data input terminal connected to a second data line D2*s*. The third pixel B13*s* may have a data input terminal connected to a third data line D3*s*. The fourth pixel R14*s* may have a data input terminal connected to a fourth data line D4*s*.

A first amplifier BUF1*s* may have an output terminal connected to the first data line D1*s* and may be connected to first high voltage power source VDD1*s* and first low voltage power source VSS1*s*. A second amplifier BUF2*s* may have an output terminal connected to the second data line D2*s* and may be connected to second high voltage power source VDD2*s* and second low voltage power source VSS2*s*. A third amplifier BUF3*s* may have an output terminal connected to the third data line D3*s* and may be connected to third high voltage power source VDD3*s* and third low voltage power source VSS3*s*.

Meanwhile, the fourth amplifier BUF4*s* may have an output terminal connected to the fourth data line D4*s* and may be connected to the first high voltage power source VDD1*s* and the first low voltage power source VSS1*s*.

In an embodiment, the first pixel R11*s* and the fourth pixel R14*s* may be pixels of (i.e., to provide) a first color, the second pixel G12*s* may be a pixel of (i.e., to provide) a second color different from the first color, and the third pixel may be a pixel of (i.e., to provide) a third color different from the first color and the second color. For example, the first to third colors may correspond to red, green, and blue, respectively.

Light emitting diodes LD of different colors may have different light emitting efficiencies. That is, different voltages may be desirable to exhibit the same luminance. For example, in order to exhibit a luminance corresponding to 255 grayscale (or gray level), a red light emitting diode may require a data voltage of 2 V, a green light emitting diode may require a data voltage of 1 V, and a blue light emitting diode may require a data voltage of 3 V. Therefore, it is effective to apply different upper and lower limits to the data voltages of light emitting diodes of respective colors.

According to the present embodiment, because heat loss may be reduced while minimizing or reducing the power provided from the buffer power generator BPG by using the same high voltage power source and/or low voltage power source for the data lines D1*s* and D4*s* to which the pixels R11*s* and R14*s* of the same color are connected, power consumption of the display device 10 may be reduced.

The following describes the RGB stripe structure in more detail.

The fifth pixel R21*s* may be the first color (i.e., to provide the first color) and a data input terminal may be connected to the first data line D1*s*. The sixth pixel G22*s* may be the second color (i.e., to provide the second color), and a data input terminal may be connected to the second data line D2*s*. The seventh pixel B23*s* may be the third color (i.e., to provide the third color), and a data input terminal may be connected to the third data line D3*s*. The eighth pixel R24*s* may be the first color (i.e., to provide the first color), and a data input terminal may be connected to the fourth data line D4*s*.

Scan input terminals of the first pixel R11*s*, the second pixel G12*s*, the third pixel B13*s*, and the fourth pixel R14*s* may be connected to a first scan line S1*s*. Scan input terminals of the fifth pixel R21*s*, the sixth pixel G22*s*, the seventh pixel B23*s*, and the eighth pixel R24*s* may be connected to a second scan line S2*s* next to the first scan line S1*s*. The second scan line S2*s* may be the most adjacent scan line of the first scan line S1*s*.

Figure 13:
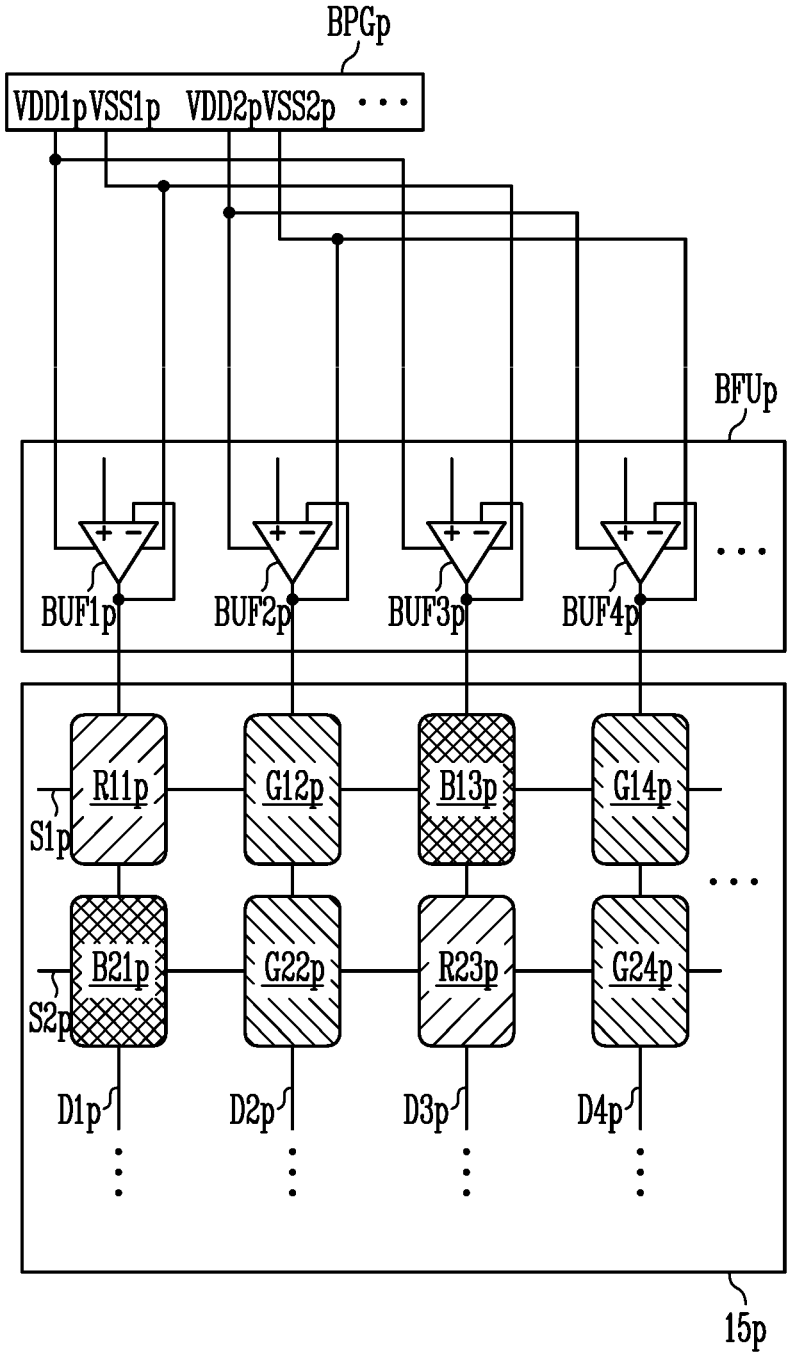
FIG. 13 is a diagram for describing an embodiment of the disclosure, which is applicable when the pixel unit is configured in a pentile structure.

FIG. 13 is a diagram for describing an embodiment of the disclosure, which is applicable when the pixel unit is configured in a pentile structure.

Referring to FIG. 13, a pixel unit 15*p* includes pixels R11*p* to G24*p* arranged in a pentile structure.

The first pixel R11*p* may have a data input terminal connected to a first data line D1*p*. The second pixel G12*p* may have a data input terminal connected to a second data line D2*p*. The third pixel B13*p* may have a data input terminal connected to a third data line D3*p*. The fourth pixel G14*p* may have a data input terminal connected to a fourth data line D4*p*.

A first amplifier BUF1*p* may have an output terminal connected to the first data line D1*p* and may be connected to first high voltage power source VDD1*p* and first low voltage power source VSS1*p*. A second amplifier BUF2*p* may have an output terminal connected to the second data line D2*p* and may be connected to second high voltage power source VDD2*p* and second low voltage power source VSS2*p*.

Meanwhile, a third amplifier BUF3*p* may have an output terminal connected to the third data line D3*p* and maybe connected to first high voltage power source VDD1*p* and the first low voltage power source VSS1*p*. In addition, a fourth amplifier BUF4*p* may have an output terminal connected to the fourth data line D4*p* and may be connected to the second high voltage power source VDD2*p* and the second low voltage power source VSS2*p*.

In an embodiment, the first pixel R11*p* may be a pixel of a first color, the second pixel G12*p* and the fourth pixel G14*p* may be pixels of a second color different from the first color, and the third pixel B13*p* may be a pixel of a third color different from the first color and the second color. For example, the first to third colors may correspond to red, green, and blue, respectively.

Light emitting diodes LD of different colors may have different light emitting efficiencies. That is, different voltages may be desirable to exhibit the same luminance. For example, in order to exhibit a luminance corresponding to 255 grayscale (or gray level), a red light emitting diode may require a data voltage of 2 V, a green light emitting diode may require a data voltage of 1 V, and a blue light emitting diode may require a data voltage of 3 V. Therefore, it is effective to apply different upper and lower limits for the data voltages of light emitting diodes of respective colors.

However, it is effective to apply the same upper limit and lower limit to the data voltages of green light emitting diodes having the best light emitting efficiency. In addition, it is effective to apply the same upper limit and lower limit to the data voltages of the red light emitting diode and the blue light emitting diode having relatively low light emitting efficiency.

According to the present embodiment, because heat loss may be reduced while minimizing or reducing the power provided from the buffer power generator BPGp by using the same high voltage power source and/or low voltage power source according to the light emitting efficiency, power consumption of the display device 10 may be reduced.

The following describes the pentile structure in more detail.

The fifth pixel B21*p* may be the third color, and a data input terminal may be connected to the first data line D1*p*. The sixth pixel G22*p* may be the second color, and a data input terminal may be connected to the second data line D2*p*. The seventh pixel R23*p* may be the first color, and a data input terminal may be connected to the third data line D3*p*. The eighth pixel G24*p* may be the second color, and a data input terminal may be connected to the fourth data line D4*p*.

Scan input terminals of the first pixel R11*p*, the second pixel G12*p*, the third pixel B13*p*, and the fourth pixel G14*p* may be connected to a first scan line S1*p*. Scan input terminals of the fifth pixel B21*p*, the sixth pixel G22*p*, the seventh pixel R23*p*, and the eighth pixel G24*p* may be connected to a second scan line S2*p* next to (or adjacent to) the first scan line S1*p*. The second scan line S2*p* may be the most adjacent scan line of the first scan line S1*p*.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Further, the use of "may" when describing embodiments of the inventive concept refers to "one or more embodiments of the inventive concept."

It will be understood that when an element or layer is referred to as being "on", "connected to", or "adjacent to" another element or layer, it can be directly on, connected to, or adjacent to the other element or layer, or one or more intervening elements or layers may be present. In contrast, when an element or layer is referred to as being "directly on," "directly connected to," or "immediately adjacent to" another element or layer, there are no intervening elements or layers present.

As used herein, the terms "use," "using," and "used" may be considered synonymous with the terms "utilize," "utilizing," and "utilized," respectively.

The display devices and/or any other relevant devices or components according to embodiments of the present disclosure described herein, such as, for example, a timing controller, a scan driver, a data driver, and a light emitting driver, may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of ordinary skill in the art should recognize that the functionality of various computing/electronic devices may be combined or integrated into a single computing/electronic device, or the functionality of a particular computing/electronic device may be distributed across one or more other computing/electronic devices without departing from the spirit and scope of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

The drawings referred to so far and the detailed description of the disclosure described herein are merely examples of the disclosure, are used for merely describing the disclosure, and are not intended to limit the meaning and the scope of the disclosure described in claims. Therefore, those skilled in the art will understand that various modifications and equivalent other embodiments are possible from these. Thus, the true scope of the disclosure should be determined by the technical spirit of the appended claims, and equivalents thereof.

What is claimed is:

1. A display device comprising:

a first amplifier having an output terminal connected to a first data line, the first amplifier being connected to a first high voltage power source and a first low voltage power source;

a second amplifier having an output terminal connected to a second data line, the second amplifier being connected to a second high voltage power source and a second low voltage power source;

a first pixel having a data input terminal connected to the first data line; and a second pixel having a data input terminal connected to the second data line, wherein the first high voltage power source and the first low voltage power source are to determine an upper limit and a lower limit of an output voltage of the first amplifier, respectively, the second high voltage power source and the second low voltage power source are to determine an upper limit and a lower limit of an output voltage of the second amplifier, respectively, and the first low voltage power source and the second low voltage power source are independent power sources.

2. The display device according to claim 1, wherein the first pixel comprises a p-type transistor having a gate electrode to receive a first data voltage output from the first amplifier, and the second pixel comprises a p-type transistor having a gate electrode to receive a second data voltage output from the second amplifier.

3. The display device according to claim 1, further comprising:

a buffer power generator comprising the first low voltage power source and the second low voltage power source, wherein the buffer power generator is to determine a voltage of the first low voltage power source based on a first grayscale value for the first pixel and is to determine a voltage of the second low voltage power source based on a second grayscale value for the second pixel.

4. The display device according to claim 3, wherein the buffer power generator is to determine that the voltage of the first low voltage power source is lesser in value when the first grayscale value becomes greater in value and to determine that the voltage of the first low voltage power source is greater in value when the first grayscale value becomes lesser in value.

5. The display device according to claim 3, wherein a voltage difference between the first low voltage power source and a first data voltage output from the first amplifier based on the first grayscale value corresponds to a voltage difference between the second low voltage power source and a second data voltage output from the second amplifier based on the second grayscale value.

6. The display device according to claim 3, wherein the first high voltage power source and the second high voltage power source are independent power sources, and the buffer power generator is to determine a voltage of the first high voltage power source based on the first grayscale value and to determine the voltage of the second high voltage power source based on the second grayscale value.

7. The display device according to claim 6, wherein the buffer power generator is to determine that the voltage of the first high voltage power source is lesser in value when the first grayscale value becomes greater in value and to determine that the voltage of the first high voltage power source is greater in value when the first grayscale value becomes lesser in value.

8. The display device according to claim 6, wherein a voltage difference between the first high voltage power source and a first data voltage output from the first amplifier based on the first grayscale value corresponds to a voltage difference between the second high voltage power source and a second data voltage output from the second amplifier based on the second grayscale value.

9. The display device according to claim 1, further comprising:

a third amplifier having an output terminal connected to a third data line, and connected to a third high voltage power source and a third low voltage power source;

a fourth amplifier having an output terminal connected to a fourth data line, and connected to the first high voltage power source and the first low voltage power source;

a third pixel having a data input terminal connected to the third data line; and a fourth pixel having a data input terminal connected to the fourth data line, wherein the first pixel and the fourth pixel are to provide a first color, the second pixel is to provide a second color different from the first color, and the third pixel is to provide a third color different from the first color and the second color.

10. The display device according to claim 9, further comprising:

a fifth pixel to provide the first color and having a data input terminal connected to the first data line;

a sixth pixel to provide the second color and having a data input terminal connected to the second data line;

a seventh pixel to provide the third color and having a data input terminal connected to the third data line; and an eighth pixel to provide the first color and having a data input terminal connected to the fourth data line, wherein scan input terminals of the first pixel, the second pixel, the third pixel, and the fourth pixel are connected to a first scan line, and scan input terminals of the fifth pixel, the sixth pixel, the seventh pixel, and the eighth pixel are connected to a second scan line next to the first scan line.

11. The display device according to claim 1, further comprising:

a third amplifier having an output terminal connected to a third data line, and connected to the first high voltage power source and the first low voltage power source;

a fourth amplifier having an output terminal connected to a fourth data line, and connected to the second high voltage power source and the second low voltage power source;

a third pixel having a data input terminal connected to the third data line; and a fourth pixel having a data input terminal connected to the fourth data line, wherein the first pixel is to provide a first color, the second pixel and the fourth pixel are to provide a second color different from the first color, and the third pixel is to provide a third color different from the first color and the second color.

12. The display device according to claim 11, further comprising:

a fifth pixel to provide the third color and having a data input terminal connected to the first data line;

a sixth pixel to provide the second color and having a data input terminal connected to the second data line;

a seventh pixel to provide the first color and having a data input terminal connected to the third data line; and an eighth pixel to provide the second color and having a data input terminal connected to the fourth data line, wherein scan input terminals of the first pixel, the second pixel, the third pixel, and the fourth pixel are connected to a first scan line, and scan input terminals of the fifth pixel, the sixth pixel, the seventh pixel, and the eighth pixel are connected to a second scan line next to the first scan line.

13. A display device comprising:

a first amplifier having an output terminal connected to a first data line, the first amplifier being connected to a first high voltage power source and a first low voltage power source;

a second amplifier having an output terminal connected to a second data line, the second amplifier being connected to a second high voltage power source and a second low voltage power source;

a first pixel having a data input terminal connected to the first data line; and a second pixel having a data input terminal connected to the second data line, wherein the first high voltage power source and the first low voltage power source are to determine an upper limit and a lower limit of an output voltage of the first amplifier, respectively, the second high voltage power source and the second low voltage power source are to determine an upper limit and a lower limit of an output voltage of the second amplifier, respectively, and the first high voltage power source and the second high voltage power source are independent power sources.

14. The display device according to claim 13, wherein the first pixel comprises an n-type transistor having a gate electrode to receive a first data voltage output from the first amplifier, and the second pixel comprises an n-type transistor having a gate electrode to receive a second data voltage output from the second amplifier.

15. The display device according to claim 13, further comprising:

a buffer power generator comprising the first high voltage power source and the second high voltage power source, wherein the buffer power generator is to determine a voltage of the first high voltage power source based on a first grayscale value for the first pixel and is to determine a voltage of the second high voltage power source based on a second grayscale value for the second pixel.

16. The display device according to claim 15, wherein the buffer power generator is to determine that the voltage of the first high voltage power source is greater in value when the first grayscale value becomes greater in value and to determine that the voltage of the first high voltage power source is lesser in value when the first grayscale value becomes lesser in value.

17. The display device according to claim 15, wherein a voltage difference between the first high voltage power source and a first data voltage output from the first amplifier based on the first grayscale value corresponds to a voltage difference between the second high voltage power source and a second data voltage output from the second amplifier based on the second grayscale value.

18. The display device according to claim 15, wherein the first low voltage power source and the second low voltage power source are independent power sources, and the buffer power generator is to determine a voltage of the first low voltage power source based on the first grayscale value and to determines the voltage of the second low voltage power source based on the second grayscale value.

19. The display device according to claim 18, wherein the buffer power generator is to determine that the voltage of the first low voltage power source is greater in value when the first grayscale value becomes greater in value and to determine that the voltage of the first low voltage power source is lesser in value when the first grayscale value becomes lesser in value.

20. The display device according to claim 18, wherein a voltage difference between the first low voltage power source and a first data voltage output from the first amplifier based on the first grayscale value corresponds to a voltage difference between the second low voltage power source and a second data voltage output from the second amplifier based on the second grayscale value.

* * * * *